United States Patent [19]

Wrhen

[11] Patent Number: 4,651,802

[45] Date of Patent: Mar. 24, 1987

[54] ATTACHMENT FOR CONNECTING ENDWALL MOLD FACE TO CONTINUOUS CASTER MOLD SUPPORT

[75] Inventor: Wilmer C. Wrhen, Township of Cranberry, County of Venango, Pa.

[73] Assignee: United States Steel Corporation, Pittsburgh, Pa.

[21] Appl. No.: 825,499

[22] Filed: Feb. 3, 1986

Related U.S. Application Data

[63] Continuation-in-part of Ser. No. 719,932, Apr. 4, 1985, abandoned.

[51] Int. Cl.[4] ..... B22D 11/04

[52] U.S. Cl. ..... 164/436; 164/491; 164/418

[58] Field of Search ..... 164/436, 491, 418, 341

[56] References Cited

FOREIGN PATENT DOCUMENTS 64491 11/1982 European Pat. Off. ..... 164/341

*Primary Examiner*—Kuang Y. Lin

*Attorney, Agent, or Firm*—William F. Riesmeyer, III

[57] ABSTRACT

An improvement is provided in continuous caster molds for quick disconnect of a mold wall from its spacing adjustment mechanism. A plate attached to the adjustment mechanism is aligned generally parallel to the mold wall. A pair of connections are provided adjacent upper and lower ends of the mold walls for connecting the wall to the plate. The lower connection is adapted to make the wall and plate readily separable at the lower connection. The improvement is provided in an upper connection which includes a pair of flange portions of the wall and plate having at least one pair of mateably aligned holes therein. A pin is adapted to fit in the holes of the flange portions and is threadedly engaged in the hole in one of said flange portions. Upon removal of the pin, the wall and adjustment mechanism are made readily separable and one can be lifted free of the other.

6 Claims, 4 Drawing Figures

ATTACHMENT FOR CONNECTING ENDWALL MOLD FACE TO CONTINUOUS CASTER MOLD SUPPORT

This application is a continuation-in-part of U.S. Ser. No. 719,932, filed Apr. 4, 1985, and now abandoned.

TECHNICAL FIELD

This invention relates to a continuous caster mold having opposed pairs of broad and narrow mold walls, and particularly to an improved quick disconnect attachment for connecting a narrow mold wall to its spacing adjustment mechanism.

BACKGROUND ART

Continuous caster molds for producing slabs commonly have walls formed of separate plates arranged in opposed pairs. Typically, the narrow wall plates are clamped between the broad walls of the mold and at least one of the narrow walls is movable so that the spacing between them may be adjusted. Usually, both the spacing and angular alignment of the narrow walls is adjustable for varying the width and controlling the shape of the slab being cast. The narrow walls tend to wear much faster than the broad walls primarily due to the tilted angular alignment of the narrow walls. It is desirable to be able to replace the narrow walls "on-line" without removing the mold from its support frame. This would eliminate excessive downtime for removal of the mold before the broad walls become worn to an extent requiring repair of the entire mold.

U.S. Pat. No. 4,069,863 shows one type of apparatus intended to permit "on-line" detachment of the narrow mold walls. At the lower end of the narrow mold wall a wedge-shaped nose is provided for engaging a mateable groove in the wall supporting plate. Lateral displacement of the wall with respect to the plate is prevented by lateral holding pieces located on opposite sides of the nose in the groove of the support plate. A wedge-shaped nose is also provided at the upper end of the narrow wall. A clamping piece having a tapered surface abutting the upper nose fits over a stud in the support plate. It is secured on the stud by a nut which causes the clamping piece to exert a downward force on the nose, pressing the mold wall tightly against the support plate. No provision is made at this upper connection to prevent lateral displacement of the mold wall. This can result in improper alignment of the narrow wall between the broad walls due to movement of the narrow wall after clamping or improper alignment initially. Such misalignment may damage the mold walls and require their early replacement and repair.

It is a primary object of this invention to provide an improved quick disconnect attachment for continuous caster mold walls which prevents their misalignment in a lateral direction generally parallel to the inner face of the mold wall.

It is another object of the invention to provide a simpler quick disconnect attachment for continuous caster mold walls than any such prior known attachments.

DISCLOSURE OF INVENTION

The present invention relates to a conventional continuous caster mold having opposed pairs of broad and narrow mold walls, the inner surfaces of which define a mold cavity adapted to receive molten metal therein.

The mold cavity has a generally vertical axis extending downwardly in the direction of casting. The mold has means for adjusting the spacing between the narrow mold walls by movement of at least one such wall with respect to the other. The adjustment means includes a plate aligned generally parallel to the movable wall and adjacent to an outer surface thereof. Means are provided for connection of the plate to the movable wall adjacent upper and lower ends of the wall. The lower connection means includes overlying flange portions of the movable wall and plate. These flange portions have mateably inclined surfaces aligned at an acute angle with respect to the casting direction. In one aspect, the inclined surface of the wall flange portion extends downwardly and outwardly so as to lie on top of and abut the mateably inclined surface of the plate flange portion. The improvement of this invention enhances rapid disconnection and replacement of the adjustable narrow mold wall. It includes an upper connection means which has overlying flange portions of the movable wall and plate. These flange portions have at least one pair of mateably aligned holes extending axially in a generally vertical direction therethrough. The flange portion of the mold wall in the upper connection overlies the corresponding flange portion of the plate, but is sufficiently displaced from the plate flange so as not to be abutted thereagainst. A pin having a smooth surface fits in the mateable holes of the flange portions of the upper connection with sufficiently close tolerance so as to substantially prevent displacement of the wall in any horizontal direction with respect to the plate. The pin has a shoulder adjacent to its upper end for abutting an upwardly facing surface of the wall flange portion. The pin has an exterior threaded portion on its upper end above the shoulder. Means is provided for threadedly engaging the upper portion of the pin to secure it in position and exert a downwardly directed force through the pin shoulder to the upper wall flange portion and the abutted flange portions of the lower connection means.

In another aspect, a continuous caster mold has a mold wall attached to a plate by a lower connection means which permits the plate to be readily detached from the mold wall. This aspect may be desirable where the mold wall has footrolls which become frozen to the strand when a breakout occurs. In this case, the mold may be separated and lifted away from the mold wall so that access can be gained to the mold wall for freeing it from the cast strand. Preferably, the lower connection means includes a plate flange portion overlying and resting on a wall flange portion, the flange portions having mateably inclined surfaces extending downwardly and inwardly toward the mold wall. The improvement of this aspect of the invention includes an upper connection means having a plate flange portion overlying a wall flange portion, the two flange portions having mateably aligned holes extending vertically therethrough. A pin fits in the mateable holes of the flange portions of the wall and plate of the upper connection. The pin and wall flange are adapted for threaded engagement with each other. The pin has means engaging the plate flange to secure the pin in position, said pin providing an upward force on the wall when the pin has been rotated in a first direction. This latter means may be a head for resting on the upper surface of the plate flange. The pin is also adapted to engage the hole of the plate flange with sufficiently close tolerance to substantially prevent any significant horizontal displacement of the mold wall with respect to the plate.

MODES FOR CARRYING OUT THE INVENTION

Figure 1:
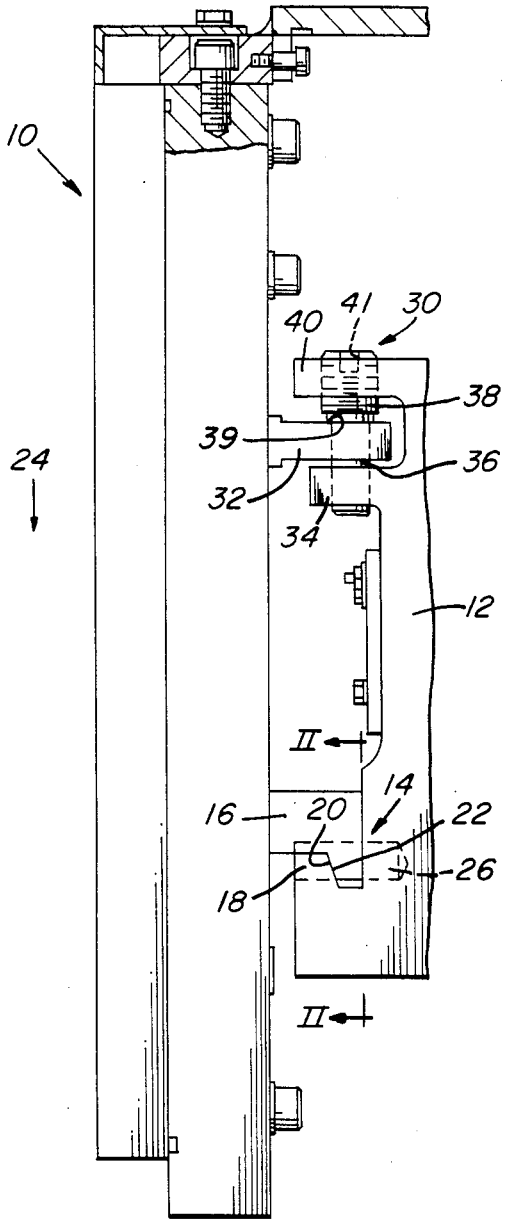
FIG. 1 is a side elevation view in partial cross-section of one of the narrow walls of a continuous caster mold showing the improvement of this invention for connecting the narrow mold wall to its spacing adjustment mechanism.

The invention will be described in relation to a conventional slab caster mold of the variable width type. An example of such a mold is shown in U.S. Pat. No. 3,292,216, the specification of which is incorporated herein by reference. Referring to FIG. 1, a conventional narrow mold wall 10 is connected to a plate 12 facing the outer surface of the narrow mold wall and aligned generally parallel to said wall. The plate in turn is connected to a mechanism (not shown) for adjusting the spacing of the narrow wall with respect to the other narrow wall. Preferably, the adjustment mechanism will also be capable of adjusting the angular alignment of the narrow wall with respect to the casting direction, as is well-known in the art. The adjustment mechanism may be of the separately actuable, twin-screw type shown in U.S. Pat. No. 3,292,216 referred to above.

Figure 2:
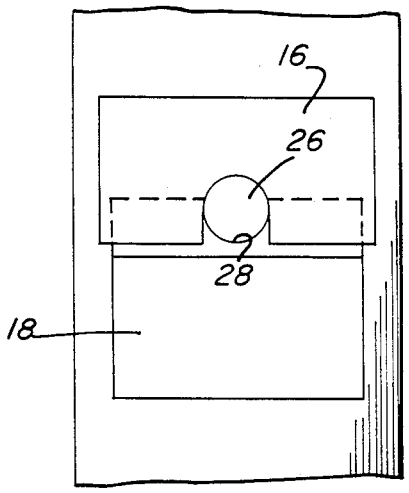
FIG. 2 is a section taken at II—II of FIG. 1.

Referring to FIGS. 1 and 2, a conventional type of readily-removable attachment 14 is provided at the lower end of the narrow wall. This attachment includes wall flange 16 overlying plate flange 18. The flanges have mateable inclined surfaces 20, 22 aligned at an acute angle extending downwardly and outwardly with respect to the generally vertical casting direction 24. The wall flange is designed to abut and rest on the upper surface of the plate flange. Means is provided for preventing lateral displacement of the flanges with respect to each other. Preferably, a pin 26 is provided in the plate flange. The pin extends normal to the outer surface of the mold wall and the adjoining surface of the plate. The wall flange has a groove 28 fitting mateably with the pin so as to maintain the proper position of the wall with respect to the plate in the lateral direction.

The improvement of this invention includes a novel attachment 30 at the upper end of the narrow wall. A pair of flanges 32, 34 are provided on the wall and plate, respectively. The flanges are aligned in overlying relationship but do not abut each other and have mateably aligned holes for receiving a pin 36 with close tolerance. The pin has a smooth surface at its lower end and an exterior threaded surface 38 at its upper end with a machined shoulder 39 therebetween for abutting an upwardly facing surface of flange 32. Means is provided for threadedly engaging the upper portion of the pin to provide a downward force on flange 32, securing the pin in position. A locknut nut may be used to secure the pin on the upper flange. However, in the preferred embodiment another flange 40 is provided extending from plate 12 and has a threaded bore for receiving the threaded portion of pin 36 therein. Pin 36 has a socket head 41 for engagement by a wrench from a location above the mold. Of course other types of heads may be provided on the pin for use with different wrenches. Unscrewing pin 36 and removing it permits the wall to be lifted free and disengaged from the plate flanges. Thus, a simple one-step operation is all that is required for removal of the narrow mold wall, significantly decreasing the amount of downtime required for it to be replaced.

Figure 3:
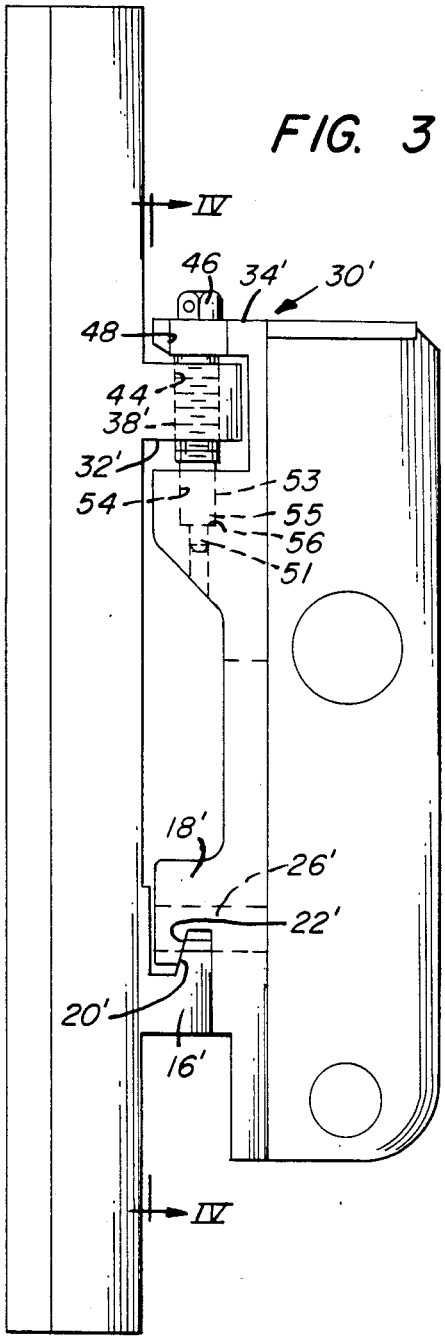
FIG. 3 is a side elevation view of one of the narrow walls of a continuous caster mold showing another aspect of the invention in which the spacing adjustment mechanism may be readily detached and lifted free of the narrow mold wall.
Figure 4:
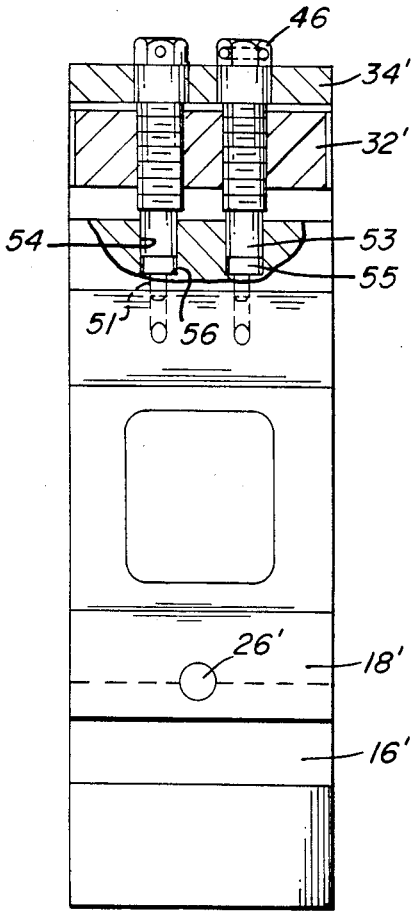
FIG. 4 is an end view in partial section taken at IV—IV of FIG. 3.

Referring to FIGS. 3 and 4, in another aspect of the invention, the mold itself may be readily detached and lifted free of the mold wall as may be desirable when a breakout occurs. Footrolls attached to the mold may become covered with metal from the breakout, freezing the rolls and mold wall to the strand. Thus, it may be desirable to be able to lift the mold and separate it from the mold wall. In this aspect, the lower connection includes plate flange portion 18' overlying wall flange portion 16', the two flange portions having mateably inclined surfaces 20' and 22' extending downwardly and inwardly toward the mold wall. The flange portion may be attached to or integral with portions of the mold wall and plate. This lower connection also has a pin 26' secured in one of the flange portions for preventing lateral movement of the mold wall with respect to the plate. The improvement in this aspect of the invention includes upper connection 30' with wall flange 32' located beneath the plate flange 34'. The pin has an exterior threaded surface 38' for threadedly engaging tapped hole 44 in the wall flange portion. Preferably, the pin has a head 46 for resting on the upper surface of the plate flange, preventing it from slipping through a smooth bore 48 in the plate flange. In this case, the pin has a smooth surface adapted to fit with close tolerance in the hole of the plate flange, so as to substantially prevent any significant displacement of the pin and mold wall in a horizontal direction. Alternatively, the head of the pin may be replaced by a threaded portion for threadedly engaging a tapped bore in the plate flange. Turning the pin in a first direction causes the wall to be raised, drawing the lower wall flange into tight engagement with the lower plate flange and connecting the wall to the plate. A hole 50 is provided in head 46 so that a rod can be used for turning the pin without using a wrench. In the preferred form illustrated, a lower portion 51 of the pin has a smooth surface adapted to fit mateably in a smooth bore of a third flange portion 52, the third flange being attached to or integral with the plate. At the lower end of the pin, a reduced diameter portion 53 fits in a hole 54 extending through flange 52. A shoulder 55 formed at the juncture of portions 51 and 53 of the pin rests on surface 56. Thus, when pin 26' seats on surface 56 further rotation of the pin draws the flanges of the lower connection together. To detach the wall from the plate, the pin is rotated in the opposite direction and removed from the flanges. Thus, separation of the mold from the wall is provided by a simple one-step operation by removal of the pin from the upper connection.

I claim:

1. In a continuous caster mold, said mold having opposed pairs of broad and narrow mold walls, said mold walls having inner surfaces defining a mold cavity adapted to receive molten metal therein, said mold cavity having a generally vertical axis extending downwardly in the direction of casting, means for adjusting the spacing between the narrow mold walls by movement of at least one wall with respect to the other, said adjustment means including a plate aligned generally parallel to said movable wall adjacent to an outer surface thereof, means for connection of said plate to the movable wall adjacent upper and lower ends thereof, said lower connection means including overlying flange portions of said movable wall and plate, said flange portions having mateably inclined abutted surfaces aligned at an acute angle with respect to the casting direction, the inclined surface of said wall flange portion extending downwardly and outwardly so as to lie on top of the mateably inclined surface of the plate flange portion, said lower connection means including means for securing the flange portions against lateral displacement with respect to each other, the improvement in said mold for enhancing rapid disconnection and replacement of the adjustable narrow mold wall which comprises:

said upper connection means including a pair of flange portions of said movable wall and plate, respectively, extending in a direction normal to said wall in overlying relationship, said wall flange portion being located above the flange portion of the plate, but being sufficiently displaced in a vertical direction so as not to be abutted thereagainst, said flange portions having at least one pair of mateably aligned holes extending axially in a generally vertical direction therethrough, a pin adapted to fit in each pair of said holes with sufficiently close tolerance to substantially prevent lateral displacement of the movable wall in horizontal directions, said pin having a shoulder adjacent an upper end thereof for abutting an upwardly facing surface of the wall flange portion, said pin having an exterior threaded portion at an upper end thereof above said shoulder, and means threadedly engaging the upper portion of said pin for securing the pin in position and exerting a downwardly directed force through the pin shoulder to the wall flange portion of the upper connection means and the abutted flange portions of the lower connection means.

2. The improved continuous caster mold of claim 1 wherein said means threadedly engaging the upper portion of said pin comprises an additional flange portion overlying said first-mentioned pair of flange portions and having a threaded opening for receiving the upper portion of the pin therein, said pin having a socket head adapted to permit easy removal of the pin from a location above the mold.

3. The improved continuous caster mold of claim 1 wherein the holes in said pair of flange portions are of circular cross-section and said pin has a cylindrical smooth surface adapted to fit in said holes.

4. In a continuous caster mold having mold walls with inner surfaces defining a mold cavity adapted to receive molten metal therein, said mold cavity having a generally vertical axis extending downwardly in the direction of casting, a plate aligned generally parallel to at least one of said mold walls adjacent to an outer surface thereof, means for connection of said plate to the mold wall adjacent upper and lower ends thereof, said lower connection means being adapted so as to make the wall and plate readily separable at said lower connection means, the improvement in said mold for enhancing rapid disconnection and separation of the mold from the mold wall which comprises:

said upper connection means including a pair of flange portions of said wall and plate, respectively, said wall flange portion of the upper connection being located below the flange portion of the plate flange portion thereof, said flange portions of the upper connection having at least one pair of mateably aligned holes extending axially in a generally vertical direction therethrough, the hole in said wall flange of the upper connection having a threaded surface, a pin adapted to fit in each pair of said holes with sufficiently close tolerance to substantially prevent lateral displacement of the wall in a horizontal direction, said pin having an exterior threaded portion engaging the threaded portion of said hole in the wall flange of said upper connection, and means for engaging the plate flange of said upper connection so as to secure the pin in position, said pin providing an upward force against the wall when the pin has been rotated in a first direction.

5. The improved continuous caster mold of claim 4 wherein said means for securing the pin in position comprises a head for resting on an upper surface of the plate flange.

6. The improved continuous caster mold of claim 4 wherein said mold has opposed pairs of broad and narrow walls, at least one of the narrow walls of said mold being adjustable for changing the spacing between the narrow walls, said adjustable narrow wall being attached to said plate.

* * * * *